US005693403A

United States Patent [19]

Brown et al.

[11] Patent Number: 5,693,403

[45] Date of Patent: Dec. 2, 1997

[54] EMBOSSING WITH REDUCED ELEMENT HEIGHT

[75] Inventors: Joseph William Brown, Appleton; Jerome Steven Veith, Menasha; Thomas Allan Eby, Greenville; Joel James Banda, Kimberly, all of Wis.

[73] Assignee: Kimberly-Clark Worldwide, Inc., Neenah, Wis.

[21] Appl. No.: 411,046

[22] Filed: Mar. 27, 1995

[51] Int. Cl.[6] ..... B31F 1/07

[52] U.S. Cl. ..... 428/153; 428/156; 428/174; 428/906; 428/220; 162/117; 162/118; 162/122

[58] Field of Search ..... 428/153, 156, 428/174, 906, 220; 162/117, 118, 122

[56] References Cited

U.S. PATENT DOCUMENTS

| | | | |
|---|---|---|---|
| D. 260,193 | 8/1981 | Elchook, Jr. et al. | D59/28 |
| D. 305,182 | 12/1989 | Peddada et al. | D5/53 |
| D. 332,874 | 2/1993 | Shufelt et al. | D5/53 |
| D. 332,875 | 2/1993 | Shufelt et al. | D5/53 |
| D. 353,053 | 12/1994 | Arnone | D5/26 |
| 2,043,351 | 6/1936 | Fourness et al. | 154/33.05 |
| 3,176,058 | 3/1965 | Mittman | 264/284 |
| 3,708,366 | 1/1973 | Donnelly | 156/209 |
| 3,867,225 | 2/1975 | Nystrand | 156/209 |
| 3,868,205 | 2/1975 | Thomas | 425/363 |
| 3,940,529 | 2/1976 | Hepford et al. | 428/178 |
| 4,189,344 | 2/1980 | Busker | 162/117 |
| 4,339,088 | 7/1982 | Niedermeyer | 242/1 |
| 4,543,142 | 9/1985 | Kuepper et al. | 156/209 |
| 4,659,608 | 4/1987 | Schulz | 428/171 |
| 4,759,967 | 7/1988 | Bauernfeind | 428/154 |
| 4,921,034 | 5/1990 | Burgess et al. | 162/109 |
| 5,093,068 | 3/1992 | Schulz | 264/284 |
| 5,269,983 | 12/1993 | Schulz | 364/25 |
| 5,356,366 | 10/1994 | Veith et al. | 493/395 |
| 5,409,572 | 4/1995 | Kershaw et al. | 162/109 |
| 5,436,057 | 7/1995 | Schulz | 428/156 |
| 5,562,805 | 10/1996 | Kamps et al. | 162/117 |

*Primary Examiner*—William Watkins
*Attorney, Agent, or Firm*—Gregory E. Croft

[57] ABSTRACT

High sheet count rolls of spot-embossed, soft bathroom tissue suffer from embossing patterns becoming pressed out by the high winding tension necessary to confine the size of the roll to a diameter of about 5 inches. This size is necessary in order for such high sheet count rolls to fit within the bathroom tissue dispensers found in most households. However, by embossing the tissue between a resilient back-up roll and an engraved embossing roll having short male embossing element heights of only from about 0.005 to about 0.035 inch, the tissue sheet becomes simultaneously calendered, which lowers the sheet caliper (as measured under a compressive load). Because of the resulting lower caliper, the embossed sheet can be wound into the required roll size with less tension on the sheet, such that the embossing pattern for tissue sheets within the roll remains well defined.

17 Claims, 4 Drawing Sheets

| | | $T_e$ | $T_t$ | T |
|---|---|---|---|---|
| A) | UNEMBOSSED BASESHEET | | .010 | .010 |
| B) | CONVENTIONAL | .0025 | .0090 | .0115 |
| C) | INVENTION | .0015 | .0070 | .0085 |

EMBOSSING WITH REDUCED ELEMENT HEIGHT

BACKGROUND OF THE INVENTION

It is well known to utilize embossing to decorate and thicken tissue products. An abundance of prior art exists which demonstrates these utilities, including U.S. Pat. No. 2,043,351 to Fourness, U.S. Pat. No. 4,189,344 to Busker, and U.S. Pat. No. 5,356,364 to Veith. Using embossing to increase sheet caliper (thicken), has allowed bathroom tissue producers to reduce the number of sheets within the roll while retaining the same package size (roll diameter). This has been a common practice in the bathroom tissue market over the past 20–25 years, particularly for household tissue products sold at grocery stores. It has not been prevalent in the service and industrial market, where it is more desireable to have high sheet counts so that the rolls last longer and have to be replenished less frequently. Also, these products are typically not so lavishly decorated with embossing as are the household tissue products.

One very popular form of decorative bathroom tissue embossing has come to be known in the trade as "spot embossing", referenced in U.S. Pat. No. 4,659,608 to Schultz. Spot embossing generally involves discrete embossing elements that are about ½ inch by ½ inch to about 1 inch by 1 inch in size (about 0.25 to about 1 square inch in surface area). These discrete spot embossing elements are spaced about ½ inch to about 1 inch apart. They are typically engraved in a steel roll about 0.060 inch in relief. In most cases spot embossing is carried out with a steel engraved roll (male elements) and a rubber covered backing roll. The design of spot embossing patterns covers a wide range of decorative shapes, some of which are the subject of design patents. For example, Kimberly-Clark has a butterfly design (U.S. Pat. No. D305,182). Other spot designs used commercially include American Can's flower (D260,193), Georgia-Pacific's angels (D332,874), Georgia-Pacific's swans (D332,875), and Potlatch's flower (D353,053). Spot embossing is commonly used not only to decorate, but also to increase sheet caliper.

In the past several years, some household bathroom tissue producers in the U.S. have begun to increase the sheet counts within the roll in order to give consumers added value. Examples are CHARMIN® Big Squeeze (450 sheet count) and NORTHERN® Big Roll (420 sheet count). In May 1992, Kimberly-Clark went even further and introduced a new product sold under the brand name of KLEENEX® Premium Bathroom Tissue—Double Roll. This product features winding the length of (2) 280 sheet count rolls into a single roll having 560 sheets. Winding two rolls into one necessarily increases the roll diameter.

However, the roll diameter of bathroom tissue products can not be too large or the rolls will not fit into the dispensers used in most households. Typically the roll diameter needs to be no greater than 5 inches in order to meet this requirement. As one would expect, it has been found to be difficult to emboss bathroom tissue for rolls having high sheet counts, e.g. 500 sheets or more, with the roll diameter constrained to 5 inches or less. This is especially true if the tissue is soft and thick. It has been found that when 500 or more sheets of soft, thick tissue are embossed and wound into a roll 5 inches or less in diameter, the embossing pattern washes out and all but disappears with time because of the high degree of winding tension necessary to attain the target roll diameter.

Therefore there is a need for a method of embossing soft, thick tissue sheets which provides a lasting embossing pattern in tissue sheets wound into high sheet count rolls.

SUMMARY OF THE INVENTION

It has now been discovered that high sheet count (about 500 sheets or more) rolls of spot-embossed, premium bath tissue can be made with substantially improved embossing pattern definition by embossing the tissue between a rubber backing roll and an engraved steel roll with reduced (lower than normal) embossing element heights. While one might expect that reducing the embossing element height might lessen the crispness and longevity of the embossing pattern, the opposite has been found to be true. It is believed the reason for the improvement is that the method of this invention essentially provides embossing and simultaneous calendering of the tissue sheet. Instead of increasing the total thickness of the tissue as is the case for conventional embossing, the method of this invention actually reduces the total sheet thickness (caliper) during embossing. The reduced sheet caliper in turn permits the use of less winding tension necessary to obtain a roll size that fits conventional bathroom tissue dispensers. The reduced winding tension and inner layer compression within the roll in turn reduce the tendency to pull out or iron out the embossing pattern in the tissue, resulting in a roll of tissue having improved embossing pattern definition. This method is particularly effective for premium quality, low stiffness tissue sheets that inherently do not hold an embossing pattern well under tension because of their resiliency.

Hence, in one aspect, the invention resides in a method of embossing a tissue sheet comprising passing the tissue sheet through an embossing nip formed between an engraved embossing roll and a smooth resilient backing roll, wherein the surface of the embossing roll contains a plurality of discrete spot embossing elements spaced apart by smooth land areas, said spot embossing elements comprising protruding male embossing elements having a height of from about 0.005 to about 0.035 inch, wherein the tissue sheet is simultaneously embossed and calendered such that the caliper of the sheet is reduced about 15 percent or greater.

In another aspect, the invention resides in a roll of spot-embossed tissue having an Average Wound Caliper (hereinafter defined) of about 0.0085 inch or less, a Residual Waviness (hereinafter defined) of about 6 micrometers or greater and a Roll Bulk (hereinafter defined) of about 6 cubic centimeters per gram or greater, wherein the tissue has a Stiffness Factor (hereinafter defined) of about 100 or less.

Tissue sheets which particularly benefit from the method of this invention are premium quality tissue sheets which have a relatively high degree of resiliency and low stiffness, such as throughdried tissue sheets. Such tissue sheets can be creped or uncreped. The basis weight of the tissue sheet can be from about 5 to about 70 grams per square meter. Although the method of this invention can be effective for wet-pressed tissue sheets, the benefits are not as pronounced relative to conventional embossing because wet-pressed sheets have a lower caliper and higher stiffness than throughdried sheets and therefore have better embossing pattern retention.

As used herein, "Average Wound Caliper" is determined by dividing the cross-sectional area of the wound roll (excluding the area of the core) by the total length of the tissue within the roll. This will be described in more detail in connection with FIG. 8. The Average Wound Caliper for the products of this invention can be about 0.0085 inch or less, more specifically about 0.006 inch or less, and suitably from about 0.003 inch to about 0.0085 inch.

"Roll Bulk" is determined by dividing the roll volume by the roll weight. Roll volume is determined by the following formula: $[\pi\times(\text{roll radius})^2 \times \text{roll width}]-[\pi\times(\text{core radius})^2 \times \text{roll width}]$. Roll volume is expressed in units of cubic centimeters. Roll weight is determined by weighing the roll and subtracting the weight of the core. Roll weight is expressed in units of grams. Roll Bulk is expressed in units of cubic centimeters per gram. The Roll Bulk for the products of this invention can be about 6 cubic centimeters per gram or greater, more specifically about 7 cubic centimeters per gram or greater, and suitably from about 7 to about 10 cubic centimeters per gram.

The "Stiffness Factor" for the tissue sheet within the roll is calculated by multiplying the MD Max Slope (hereinafter defined) by the square root of the quotient of the caliper (hereinafter defined) divided by the number of plies. The MD Max Slope is the maximum slope of the machine direction load/elongation curve for the tissue. The units for MD Max Slope are kilograms per 3 inches (7.62 centimeters). The units for the Stiffness Factor are (kilograms per 3 inches)-microns$^{0.5}$. The Stiffness Factor for tissue sheets embossed in accordance with this invention can be about 100 or less, preferably about 75 or less, and suitably from about 50 to about 100.

As used herein, "caliper" is the thickness of a single sheet, but measured as the thickness of a stack of ten sheets and dividing the ten sheet thickness by ten, where each sheet within the stack is placed with the same side up. In order to calculate the Stiffness Factor, caliper is expressed in microns. For other purposes, caliper can be expressed in inches. It is measured in accordance with TAPPI test methods T402 "Standard Conditioning and Testing Atmosphere For Paper, Board, Pulp Handsheets and Related Products" and T411 om-89 "Thickness (caliper) of Paper, Paperboard and Combined Board" with Note 3 for stacked sheets. The micrometer used for carrying out T411 om-89 is a Bulk Micrometer (TMI Model 49-72-00, Amityville, N. Y.) having an anvil pressure of 220 grams/square inch (3.39 kiloPascals). After the caliper is measured, the same ten sheets in the stack are used to determine the average basis weight of the sheets.

The "Residual Waviness", which is used to quantify the crispness or quality of the embossments in the tissue, is defined as the difference between average surface waviness (hereinafter defined) of the tissue surface occupied by the spot embossment and the average surface waviness of the immediately adjacent unembossed surface (land area). This difference is termed Residual Waviness (RW), which is a measure of the embossment quality attributable to the invention. Units of RW are in micrometers. RW values for products of this invention fall within the range of about 6 micrometers or greater, more specifically about 8 micrometers or greater, still more specifically about 10 micrometers or greater, and still even more specifically from about 6 to about 10 micrometers or greater. For roll products, RW is measured on tissue sheets positioned within the roll 0.5 inch from the outside of the core of the roll. To the extent that winding tension adversely impacts the quality of the embossments, it is apparent from sheets located at this position within the roll.

The average surface waviness (sWa) for any portion of the tissue surface is defined as the equivalent of the universally recognized common parameter describing average surface roughness of a single traverse, Ra, applied to a surface after application of a waviness cut-off filter. It is the arithmetic mean of departures of the surface from the mean datum plane calculated using all measured points. The mean datum plane is that plane which bisects the data so that the profile area above and below it are equal.

A waviness filter of 0.25 millimeter cut-off length is a computer method of separating (filtering) structural features spaced above this wavelength from those less than this wavelength, and is defined in surface metrology as a "low-pass" filter. The spot embossment elements consist of widths approximating 1 millimeter in width on the tissue. This waviness filter passes 100 percent of structures at this wavelength more or less corresponding to embossment features apparent to the unaided eye, while suppressing 100 percent of features whose wavelength equals or is less than 25 micrometers, that being typical width dimensions of individual softwood pulp fibers comprising the tissue.

Average surface waviness (sWa) data necessary for calculation of RW are obtained using a Form Talysurf Laser Interferometric Stylus Profilometer (Rank Taylor Hobson Ltd., P.O. Box 36, New Star Rd., Leicester LE4 7JQ, England). The stylus used is Part #112/1836, diamond tip of nominal 2-micrometer radius. The stylus tip is drawn across the sample surface at a speed of 0.5 millimeters/sec. The vertical (Z) range is 6 millimeters, with vertical resolution of 10.0 nanometers over this range. Prior to data collection, the stylus is calibrated against a highly polished tungsten carbide steel ball standard of known radius (22.0008 mm) and finish (Part #112/1844 [Rank Taylor Hobson, Ltd.]). During measurement, the vertical position of the stylus tip is detected by a Helium/Neon laser interferometer pick-up, Part #112/2033. Data is collected and processed using Form Talysurf Ver. 5.02 software running on an IBM PC compatible computer.

To determine the RW for a particular tissue sample, a portion of the tissue is removed with a single-edge razor or scissors (to avoid stretching the tissue) which includes the spot embossment and adjacent land area. The tissue is attached to the surface of a 2"×3" glass slide using double-side tape and lightly pressed into uniform contact with the tape using another slide.

The slide is placed on the electrically-operated, programmable Y-axis stage of the Profilometer. For purposes of measuring the butterfly embossment, for example, the Profilometer is programmed to collect a "3D" topographic map, produced by automatically datalogging 256 sequential scans in the stylus traverse direction (X-axis), each 20 millimeters in length. The Y-axis stage is programmed to move in 78-micrometer increments after each traverse is completed and before the next traverse occurs, providing a total Y-axis measurement dimension of 20 millimeters and a total mapped area measuring 20×20 millimeters. With this arrangement, data points each spaced 78 micrometers apart in both axes are collected, giving the maximum total 65,536 data points per map available with this system. The process is repeated for the adjacent land area. Because the equipment can only scan areas which are rectangular or square, for purposes of measuring RW, the area of the tissue occupied by the spot embossment is the area defined by the smallest rectangle or square which completely encompasses the spot embossment being measured. In measuring the butterfly spot embossment as described above, a 20×20 millimeter square field was appropriate, but the size and shape of the field will be different for different spot embossments. The resultant "3D" topological map, being configured as a ".MAP" computer file consisting of X-, Y- and Z-axis spatial data (elevation map), is reconstructed for analysis using Talymap 3D Ver. 2.0 software Part #112/2403 (Rank Taylor Hobson, ltd.) running on an Apple Quadra 650 computer platform. The average surface waviness (sWa) parameter is derived using the following procedures: a) leveling the map plane using a least squares fit function to remove sample tilt due to error in horizontal positioning of the tissue; b) application of a waviness filter of 0.25 millimeters cut-off length to the surface data, and resultant reconstruction of the surface map; and c) requesting the sWa parameter from this filtered surface. The measurement of sWa is repeated three times, each measurement from different areas, to obtain separate mean sWa values for the embossment and the surrounding land area. The difference between the mean sWa values for the embossment area and the land area is the RW for the embossment. The average RW for the roll of tissue is determined by averaging the embossment RW values for at least three randomly selected spot embossments. Similarly, the mean sWa values for the land areas surrounding the selected embossments can be averaged for the same three or more samples to obtain an average land area sWa for the sample. Because of the calendering effect of the embossing method of this invention, the land area sWa values of the products of this invention can be about 20 percent lower (smoother) than with conventional embossing methods. In absolute terms, the mean sWa for the land area of the embossed tissues of this invention can be from about 15 to 21, more specifically from about 17 to about 20, and more specifically from about 18 to about 20.

As mentioned above, the height of the male embossing elements is lower than one would use for spot embossing. Embossing element heights can be from about 0.005 to about 0.035 inch, more specifically from about 0.010 to about 0.030 inch, and still more specifically about 0.025 inch.

The spaced-apart discrete spot embossing elements or embossments can depict butterflies, animals, leaves, flowers, and the like. These embossing elements or embossments, taken as a whole, are sometimes herein referred to as "spot embossing elements" or "spot embossments". They are generally about 0.5 inch or greater in size (about 0.25 to about 1 square inch in area) and are spaced apart about 0.5 to about 1 inch on the tissue sheet. These spot embossing elements and spot embossments generally consist of several individual line segments which are referred to as embossing elements or embossments. For example, the butterflies depicted in FIG. 2 are spot embossments, each of which consists of seven line embossments which form the wings, body and antennae. These spaced-apart, discrete spot embossments in the tissue sheet are to be distinguished from "continuous" embossing patterns, such as parallel or intersecting line patterns, and embossing patterns having very small, closely-spaced elements, such as a multiplicity of dots and the like. A way of determining if a particular embossing pattern contains widely spaced-apart distinct spot embossments as defined above is to draw the smallest possible circle around each embossment in the embossing pattern and measure the spacing between embossments and the area within the circle. As will be described hereinafter, the portions of the tissue sheet between spot embossments (the land areas) become calendered during embossing in accordance with this invention as a result of the nip loading. The presence of these unembossed land areas is necessary to obtain the desired overall reduction in sheet caliper.

The size of the bath tissue rolls of this invention is from about 4.5 to about 5.5 inches in diameter. The overall roll length can be from about 57 to about 91 meters. The number of individual perforated sheets within the roll can be from about 500 to about 800, such perforated sheets typically being about 4.5 inches long. In addition, some tissue rolls of this invention can be further characterized by the Firmness Index, which is described in U.S. Pat. No. 5,356,364 issued Oct. 18, 1994 to Veith et al. entitled "Method For Embossing Webs", which is hereby incorporated by reference. Because of the manner in which the Firmness Index is measured, higher numbers mean lower roll firmness. Specifically, the Firmness Index values for certain tissue rolls of this invention can be from about 0.115 inch to about 0.150 inch, more specifically from about 0.120 inch to about 0.135 inch.

BRIED DESCRIPTION OF THE DRAWING

FIG. 6A is a schematic representation of an unembossed tissue sheet, FIG. 6B shows the same sheet which has been conventionally embossed, and FIG. 6C shows the same sheet which has been embossed in accordance with this invention, illustrating the changes in the thickness of the sheet.

DETAILED DESCRIPTION OF THE DRAWING

Figure 1:
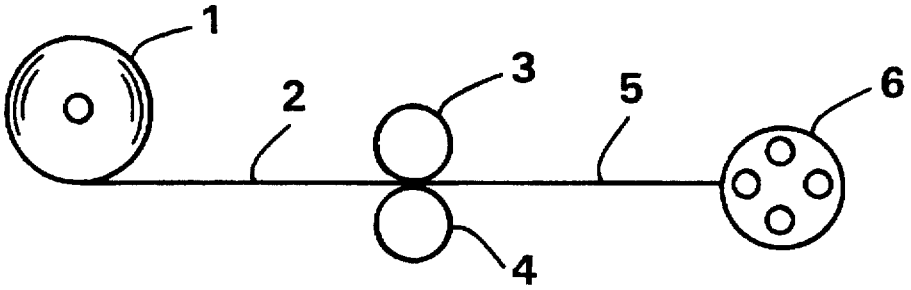
FIG. 1 is a schematic illustration of a process for embossing tissue sheets in accordance with this invention.

FIG. 1 is a schematic flow diagram illustrating a method for embossing tissue sheets in accordance with this invention. Shown is a wound roll of tissue 1, as would typically be produced by a tissue manufacturing machine, being unwound and feeding the tissue sheet 2 into the embossing nip formed between an engraved steel embossing roll 3 and a rubber-covered backing roll 4. The resulting embossed tissue sheet 5 is wound onto bathroom tissue roll cores to form logs at log winder 6. Subsequently the logs are cut into appropriate widths and the resulting individual bathroom tissue rolls are packaged.

Figure 2:
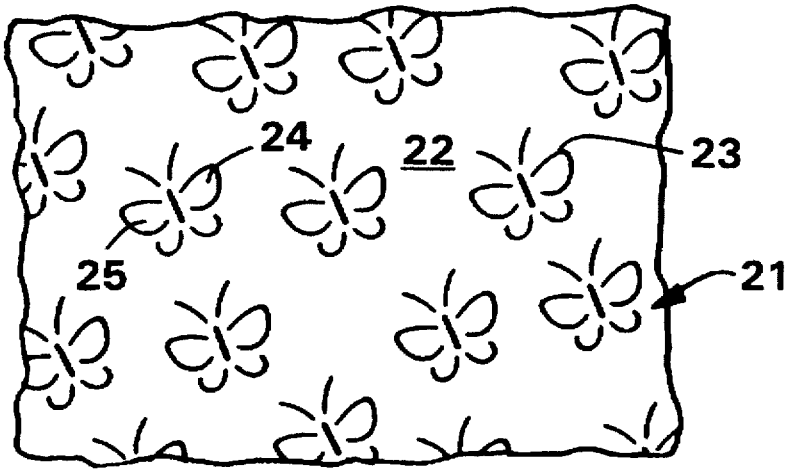
FIG. 2 is a plan view of a portion of an engraved embossing roll in accordance with this invention, illustrating an example of widely spaced-apart discrete embossing elements.

FIG. 2 is a plan view of a portion of the surface of an engraved embossing roll, illustrating an example of spaced-apart discrete spot embossing elements useful for purposes of this invention. Shown are a plurality of male spot embossing elements 21 (butterflies) separated by a smooth land area 22. For purposes herein, the unengraved portions of the embossing roll circumscribed by the spot embossing element, such as areas 24 and 25, are not considered to be part of the land area 22. The plurality of embossing element lines, such as line 23, are embossing element segments which are raised above the surface of the land area 22. The sum total of several embossing element segments constitute the spot embossing element (in this case, a butterfly). As mentioned above, it is important that the spot embossing elements be spaced-apart to leave a substantial land area to permit the tissue sheet to be simultaneously calendered. Otherwise the bulk of the tissue would be increased by the embossing step.

Figure 3:
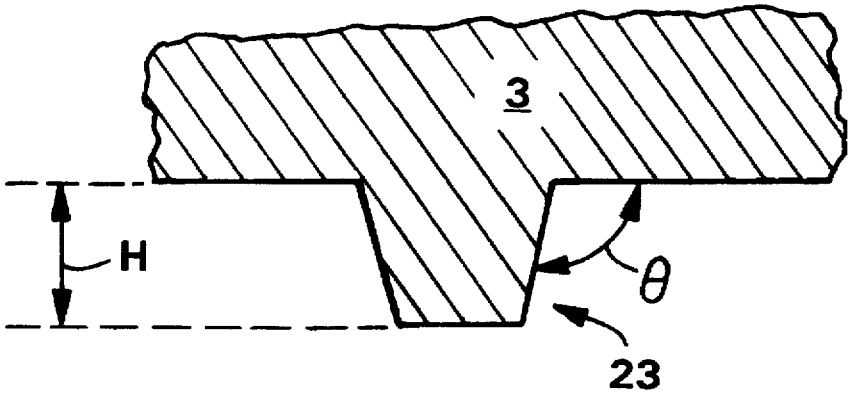
FIG. 3 is a schematic sectional view of an embossing element, illustrating its dimensions.

FIG. 3 is a schematic sectional view of a male embossing element segment, illustrating its dimensions. Shown is the embossing roll 3 with a male embossing element segment 23 which protrudes from the surface of the embossing roll a distance H (height) of from about 0.005 to about 0.35 inch. The width of the embossing element at its tip can be from about 0.005 inch to about 0.50 inch. The sidewall angle, theta, as measured relative to the plane tangent to the surface of the roll at the base of the embossing element, can be from about 90° to about 130°.

Figure 4:
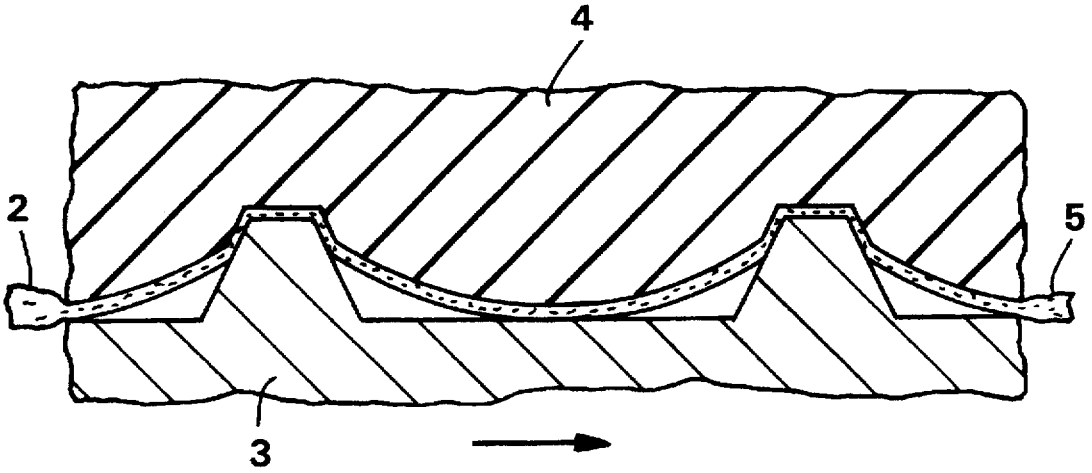
FIG. 4 is a schematic sectional view of a tissue web being embossed between an engraved steel roll and a resilient backing roll in a conventional manner

FIG. 4 is a schematic sectional view of a conventional steel/rubber embossing nip. Shown is the engraved embossing roll 3, the rubber-covered backing roll 4, the incoming tissue sheet 2 and the outgoing tissue sheet 5. As further illustrated in FIGS. 6A, 6B, and 6C, the caliper or thickness of the tissue sheet is increased as the result of the embossing.

Figure 5:
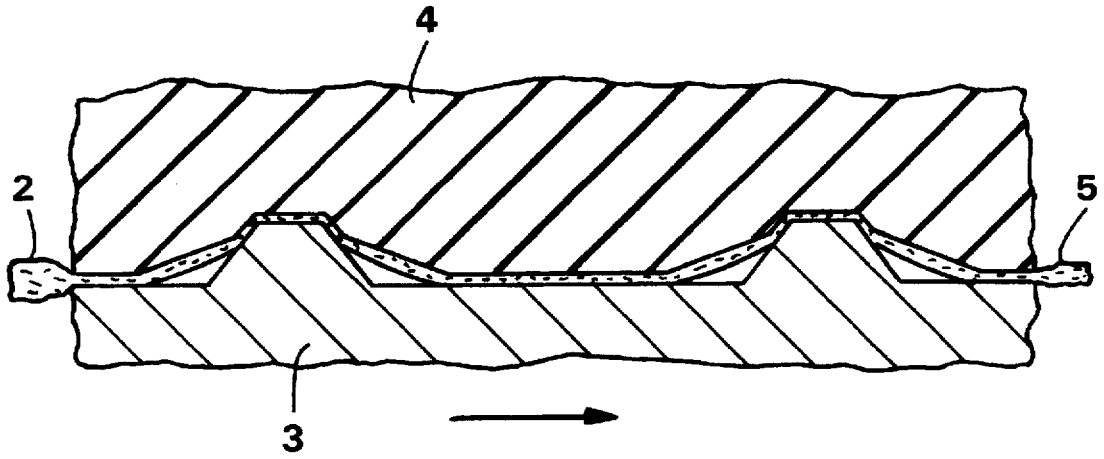
FIG. 5 is a schematic sectional view of a tissue web being embossed and calendered in accordance with this invention, illustrating the simultaneous calendering of the web.

FIG. 5 is a schematic sectional view of a tissue being embossed and calendered in an embossing nip in accordance with this invention. Shown is the engraved embossing roll 3, the rubber-covered backing roll 4, the incoming tissue sheet 2 and the outgoing tissue sheet 5. As further illustrated in FIGS. 6A, 6B, and 6C, the caliper of the tissue sheet is substantially reduced even though the sheet has been embossed with a decorative spot embossing pattern. It will be appreciated that this schematic illustration oversimplifies the dynamics of the embossing nip since the spot embossing elements consist of several embossing element segments and their cross-sectional shapes and frequencies will differ depending on the angle at which the cross-section is viewed. The primary purpose of FIG. 5 is simply to illustrate the overall compression of the web (calendering) in areas besides those areas where the embossing elements are present.

Figures 6, 7:
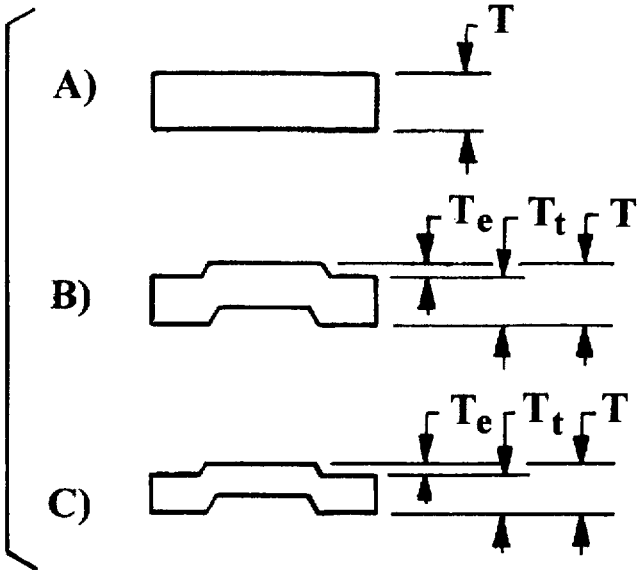
FIG. 7 is a table numerically illustrating the changes in thickness one might expect from conventional embossing as compared to embossing in accordance with this invention.

FIG. 7 is a table illustrating hypothetical, but realistic, numerical values for tissue thicknesses in the unembossed state (A) as shown in FIG. 6A, conventionally embossed (B) as shown in FIG. 6B, and embossed in accordance with this invention (C) as shown in FIG. 6C. "$T_e$" is the height of the embossment in the tissue after embossing. "$T_r$" is the thickness of the tissue web in the unembossed or land areas of the tissue. "T" is the total thickness of the web. As illustrated in the table of FIG. 7, an unembossed tissue having a thickness of 0.0100 inch will have a total thickness of about 0.0115 inch when conventionally embossed with embossing elements having a height of about 0.040 inch. However, the same web embossed in accordance with this invention will have a total thickness of only about 0.0085 inch when embossed with embossing elements having a height of about 0.025 inch.

Figure 8:
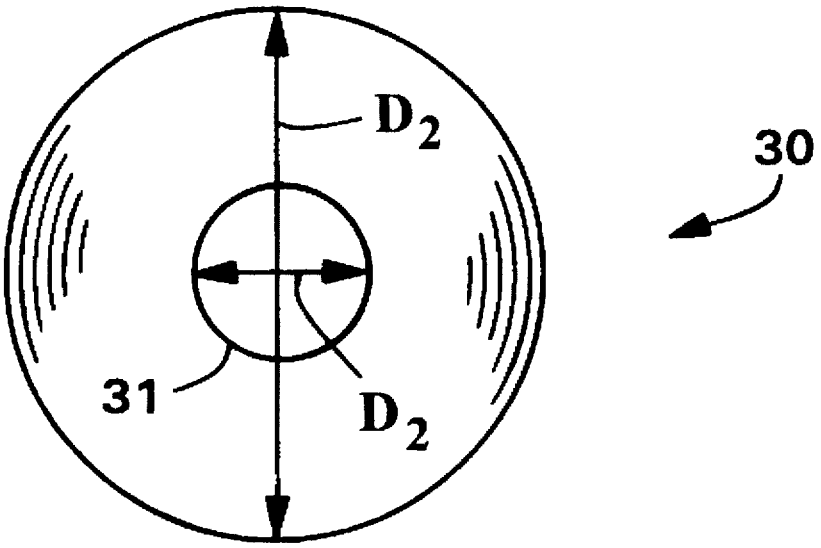
FIG. 8 is an axial view of a bath tissue roll, shown for purposes of illustrating the calculation of the Average Wound Caliper.

FIG. 8 is an axial or end view of a bath tissue roll, illustrating the dimensions necessary to calculate Average Wound Caliper. Shown is the roll of bath tissue 30, the roll core 31, the outside diameter of the core $D_1$ and the diameter of the roll $D_2$. The cross-sectional area of the roll attributable to the wound tissue is the area of the roll minus the area of the core and is calculated as $0.25\ (\pi)\ (D_2^2-D_1^2)$. The calculated area, divided by the length of the tissue sheet wound onto the roll, is the Average Wound Caliper of the roll.

EXAMPLES

Example 1. (Conventional Embossing)

A throughdried tissue sheet having a basis weight of about 16.7 pounds per 2880 square feet was manufactured and wound into a roll. The sheet was embossed, rewound and converted into bathroom tissue rolls having a diameter of 5.05 inches as illustrated in FIG. 1. The embossing rolls consisted of an engraved steel male embossing roll having the butterfly spot embossing pattern illustrated in FIG. 2. The height of the embossing elements was 0.040 inch. The smooth resilient backing roll was a rubber covered roll having a Shore A hardness of 70 Durometer. The rewinder production efficiency was negatively impacted under these conditions resulting in winder "blow-outs" and frequent rethreading as a consequence of high web tensions necessary to obtain a 5 inch roll diameter with a sheet count of 560.

The resulting rolls of bath tissue had the following properties: an Average Wound Caliper of 0.0074 inch; a Roll Bulk of 7.03 cubic centimeters per gram; a Stiffness Factor of 98.1 (kilograms per 3 inches)-microns$^{0.5}$; a Firmness Index of 0.105 inch; and a Residual Waviness of 5.23 micrometers.

Example 2. (This Invention)

The same tissue basesheet was processed as described in Example 1, except the height of the male embossing elements was reduced from 0.040 inch to 0.025 inch. Rewinder production efficiency was noticeably improved, as was the visual quality of the embossing pattern in the final product form.

The resulting rolls of bath tissue had the following properties: an Average Wound Caliper of 0.0074 inch; a Roll Bulk of 7.03 cubic centimeters per gram; a Stiffness Factor of 98.1 (kilograms per 3 inches)-microns$^{0.5}$; a Firmness Index of 0.125 inch; and a Residual Waviness of 8.46 micrometers.

It will be appreciated that the foregoing examples, given for purposes of illustration, are not to be construed as limiting the scope of this invention, which is defined by the following claims and all equivalents thereto.

We claim:

1. A roll of spot-embossed tissue having an Average Wound Caliper of about 0.0085 inch or less, a Residual Waviness of about 6 micrometers or greater and a Roll Bulk of about 6 cubic centimeters per gram or greater, wherein the tissue has a Stiffness Factor of about 100 (kilograms per 3 inches)-microns$^{0.5}$ or less.

2. The tissue roll of claim 1 wherein the tissue is a throughdried tissue.

3. The tissue roll of claim 1 wherein the Average Wound Caliper is about 0.006 inch or less.

4. The tissue roll of claim 1 wherein the Average Wound Caliper is from about 0.003 inch to about 0.0085 inch.

5. The tissue roll of claim 1 wherein the Residual Waviness is about 8 micrometers or greater.

6. The tissue roll of claim 1 wherein the Residual Waviness is about 10 micrometers or greater.

7. The tissue roll of claim 1 wherein the Residual Waviness is from about 6 to about 10 micrometers.

8. The tissue roll of claim 1 wherein the Roll Bulk is about 7 cubic centimeters per gram or greater.

9. The tissue roll of claim 1 wherein the Roll Bulk is from about 7 to about 10 cubic centimeters per gram.

10. The tissue roll of claim 1 wherein the Stiffness Factor of the tissue is about 75 (kilograms per 3 inches)-microns$^{0.5}$ or less.

11. The tissue roll of claim 1 wherein the Stiffness Factor of the tissue is from about 50 to about 100 (kilograms per 3 inches)-microns$^{0.5}$.

12. The tissue roll of claim 1 wherein the length of tissue within the roll is from about 57 to about 91 meters.

13. A roll of spot-embossed tissue having multiple spot embossments spaced apart by unembossed land areas, said tissue roll having an Average Wound Caliper of from about 0.003 to about 0.0085 inch, a Residual Waviness of from about 6 to about 10 micrometers and a Roll Bulk of from about 7 to about 10 cubic centimeters per gram, wherein the tissue has a Stiffness Factor of from about 50 to about 100 (kilograms per 3 inches)-microns$^{0.5}$.

14. The tissue roll of claim 13 wherein the tissue is throughdried.

15. The tissue roll of claim 14 wherein the tissue is creped.

16. The tissue roll of claim 14 wherein the unembossed land area has a mean sWa of from about 15 to 21.

17. The tissue roll of claim 14 wherein the land area surrounding the embossments has a mean sWa of from about 17 to about 20.

* * * * *